US006672117B2

(12) United States Patent
Yu

(10) Patent No.: US 6,672,117 B2
(45) Date of Patent: Jan. 6, 2004

(54) SHIELDED WINDOW STRUCTURE OF NUMERAL LOCK

(76) Inventor: Chun Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/128,311

(22) Filed: Apr. 24, 2002

(65) Prior Publication Data

US 2003/0200775 A1 Oct. 30, 2003

(30) Foreign Application Priority Data

Dec. 31, 2001 (TW) ..... 90224106 U

(51) Int. Cl.[7] ..... E05B 69/00; E05B 73/00

(52) U.S. Cl. ..... 70/58; 70/312; 70/33 R; 70/333 A

(58) Field of Search ..... 70/30, 312, 28, 70/426, 333 R, 333 A, 58

(56) References Cited

U.S. PATENT DOCUMENTS 5,042,277 A * 8/1991 Jenn-Rong ..... 70/28
5,787,736 A * 8/1998 Ling ..... 70/26
5,791,169 A * 8/1998 Kuo ..... 70/26
5,850,751 A * 12/1998 Kuo ..... 70/26
5,924,313 A * 7/1999 Kuo ..... 70/26
6,058,744 A * 5/2000 Ling ..... 70/28
6,305,197 B1 * 10/2001 Ling ..... 70/30
6,401,502 B1 * 6/2002 Yang ..... 70/30
6,449,992 B1 * 9/2002 Yu et al. ..... 70/58
6,463,770 B1 * 10/2002 Lee ..... 70/58
6,513,356 B1 * 2/2003 Yang ..... 70/213
6,523,373 B1 * 2/2003 Su ..... 70/58

* cited by examiner

*Primary Examiner*—John B. Walsh
(74) *Attorney, Agent, or Firm*—Troxell Law Office PLLC

(57) ABSTRACT

Shielded window structure of a numeral lock. A window member is disposed on one side of the housing of the lock. The window member is formed with a row of windows through which the numerals of a row of numeral wheels are shown. The linking member is drivingly connected with an internal driving plate for driving internal components to control locking/unlocking of a hook member at one end of the housing. The window member is synchronously horizontally displaceably or deflectably connected with the linking member. When moving the linking member to unlock the lock, the window member is synchronously displaced to disalign the windows from the unlocking number of the numeral wheels so as to shield the unlocking member and prevent an unauthorized person from seeing the unlocking number.

13 Claims, 11 Drawing Sheets

SHIELDED WINDOW STRUCTURE OF NUMERAL LOCK

BACKGROUND OF THE INVENTION

The present invention is related to a shielded window structure of numeral lock. When pressing a press button to unlock the lock, the window structure is displaced to at the same time shield the unlocking number.

A conventional numeral lock includes a row of numeral wheels for selectively setting an unlocking number.

The surface of the lock casing is marked with an indication line. The numeral wheels are partially exposed to outer side. A user can turn the numeral wheels to align a certain number with the indication line and show the true positions of the numeral wheels. The indication line and the numeral wheels are likely to be worn out after a period of time of operation. Therefore, it will be hard to accurately align the number with the indication line.

The casing of an existent numeral lock is formed with multiple windows respectively corresponding to the positions of the numeral wheels. When a row of unlocking numerals are shown through the windows, a user can press an unlocking button to unlock an article.

The windows are directly formed on the surface of the casing of the lock. The press button is positioned on outer side of the casing for a user to press to drive internal components for unlocking. The unlocking number is clearly shown through the windows for easy operation. However, an unauthorized person can also clearly see the unlocking number.

SUMMARY OF THE INVENTION

It is therefore a primary object of the present invention to provide a shielded window structure of numeral lock. When pushing a press button to unlock the lock, the window member is synchronously displaced to shield the unlocking member of numeral wheels.

According to the above object, the shielded window structure of numeral lock of the present invention includes a row of numeral wheels disposed in a housing of the lock. The circumferences of the numeral wheels are partially exposed to outer side through at least one face of the housing for easy turning. A press button is drivingly connected with internal components to control locking/unlocking of the lock. A window member is disposed on one side of the housing corresponding to the numeral wheels. The window member is formed with a row of windows through which the numerals of the numeral wheels are exposed. The press button is drivingly connected with an internal driving plate for driving internal locking components, The driving plate is integrally formed with the window member. When the numeral wheels are such turned to show the unlocking number through the windows, the press button can be pressed to unlock the lock. At this time, the window member is synchronously displaced to shield the unlocking member of the numeral wheels.

The window member can be synchronously horizontally displaceable or deflectable to disalign the windows from the unlocking number of the numeral wheels so as to shield the unlocking member.

The present invention can be best understood through the following description and accompanying drawings wherein:

DETAILED DESCRIPTION OF THE PREFERRED EMBODIMENTS

Figure 1:
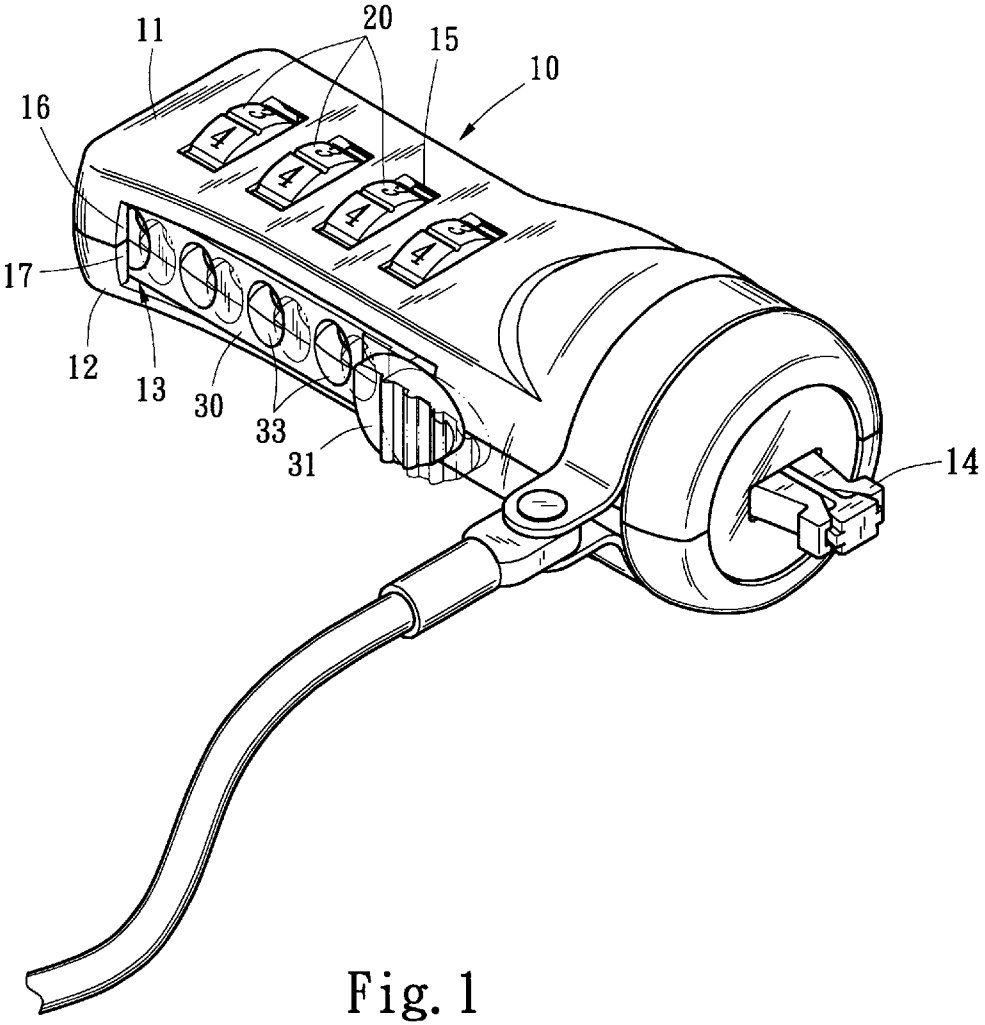
FIG. 1 is a perspective assembled view of a preferred embodiment of the present invention in an unlocking state, in which the phantom line shows a locking position of the press button.

Please refer to FIG. 1 which shows a computer-used external numeral lock 10. The numeral lock 10 has a housing composed of an upper and a lower casings 11, 12. A row of numeral wheels 20 are arranged in the housing. Each numeral wheel 20 has numerals of 0 to 9 on outer circumference. The circumference of the numeral wheel 20 is partially exposed to outer side of the lock 10 for a user to turn. One side of the housing is formed with a slot 13 in which a window member 30 is disposed. A linking member 31 (such as a press button) is disposed on outer side of the window member 30 for a finger to shift. A hook member 14 is disposed at one end of the lock 10 for locking or unlocking an article (computer).

Figure 2:
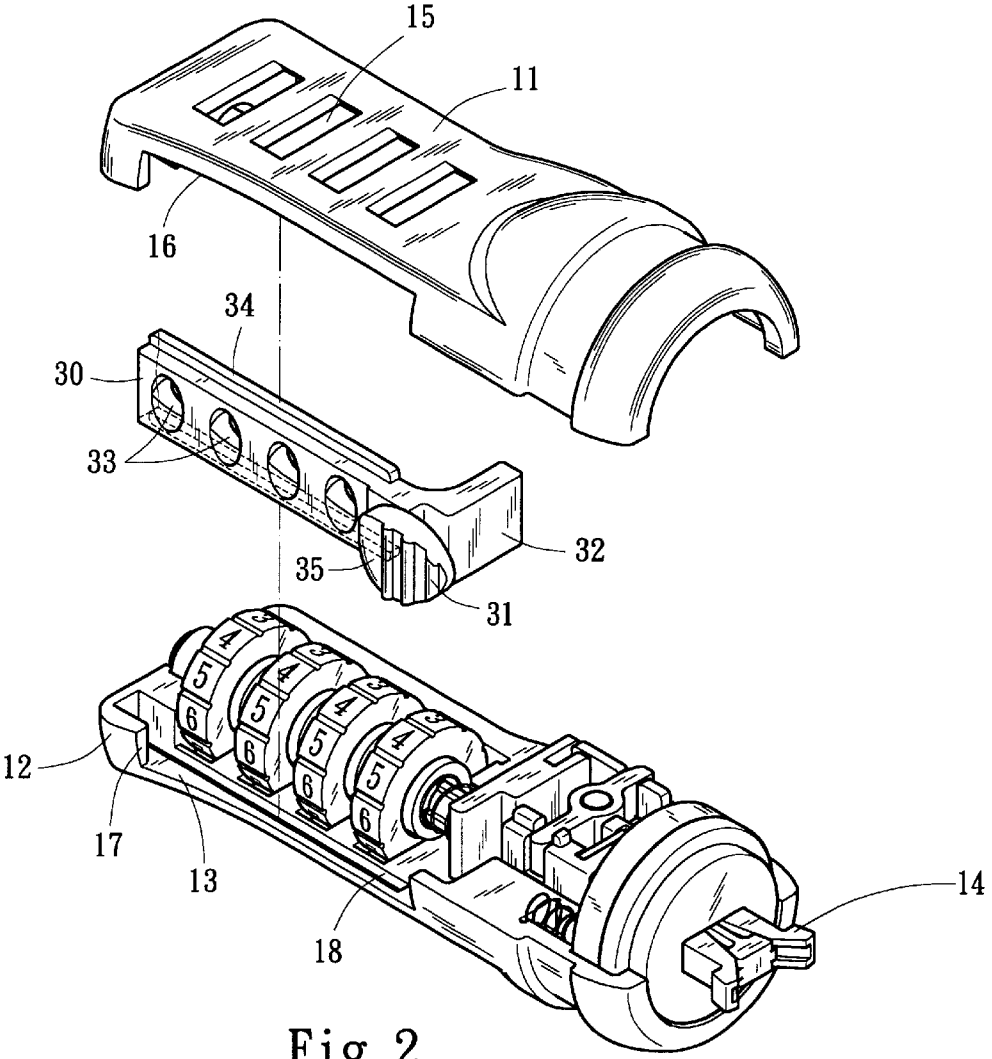
FIG. 2 is a perspective exploded view according to FIG. 1.
Figure 3:
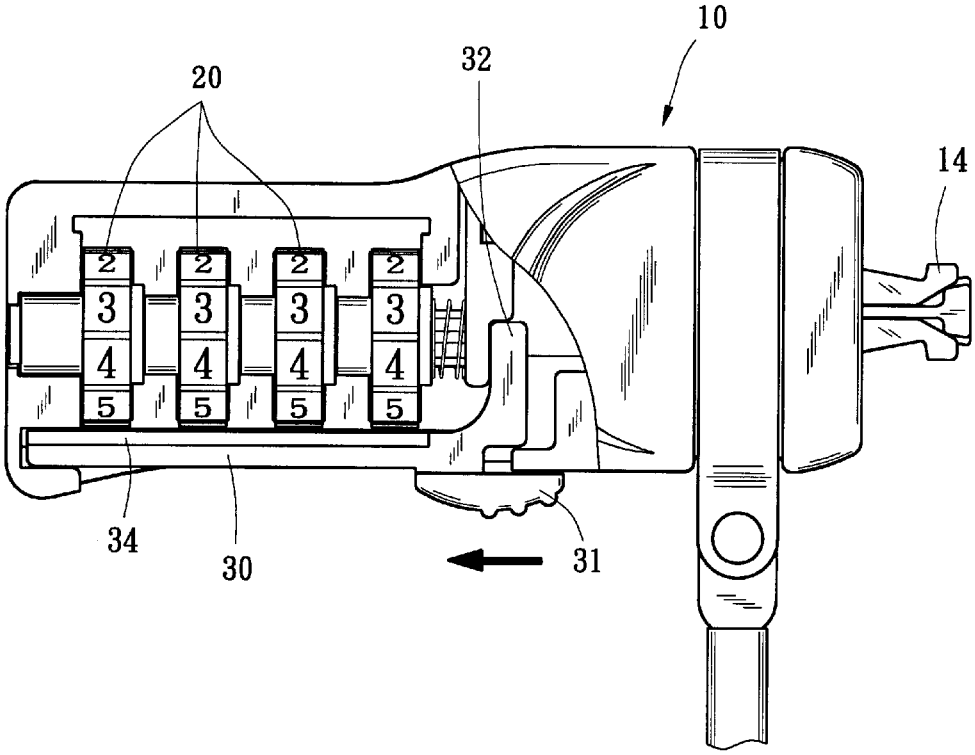
FIG. 3 is a front and partially sectional view according to FIG. 1, showing a locking state of the present invention.
Figure 4:
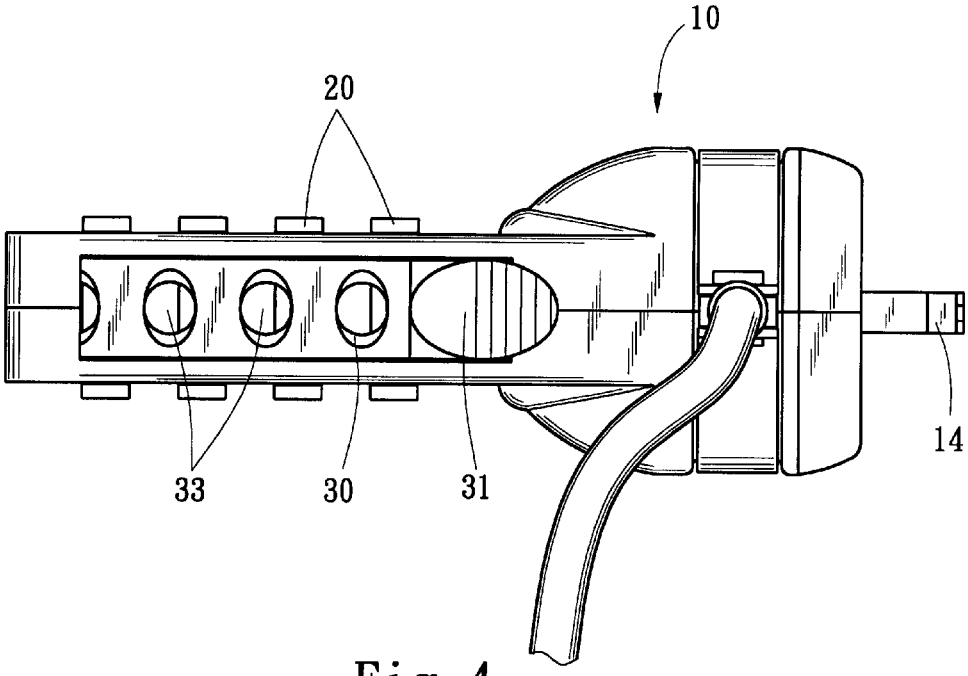
FIG. 4 is a side view according to FIG. 3.

Referring to FIGS. 2 to 4, the window member 30 is integrally formed with the driving plate 32 for driving internal components to unlock the article. When the press button 31 is pressed, the window member 30 and the driving plate 32 are synchronously moved. In this embodiment, one end section of the window member 30 is bent to form the driving plate 32. Multiple windows 33 are transversely arranged at intervals along the width of the window member 30. The windows 33 are slightly larger than the numerals of the numeral wheels 20. The upper and lower sides of the window member 30 are respectively formed with slide ribs 34, 35 which are slidably assembled with the upper and lower casings 11, 12.

The upper and lower surfaces of the upper and lower casings 11, 12 are formed with a row of slots 15 for partially exposing the numeral wheels 20. In addition, the lateral sides of the upper and lower casings 11, 12 are formed with elongated notches 16, 17 which together form an elongated slot 13 in which the window member 30 is disposed. The inner side of the elongated slot 13 is formed with upper and lower opposite channel rails 18. When the upper and lower casings 11, 12 are mated with each other, the slide ribs 34, 35 of the window member 30 are slidably inlaid and located in the channel rails 18.

Figure 5:
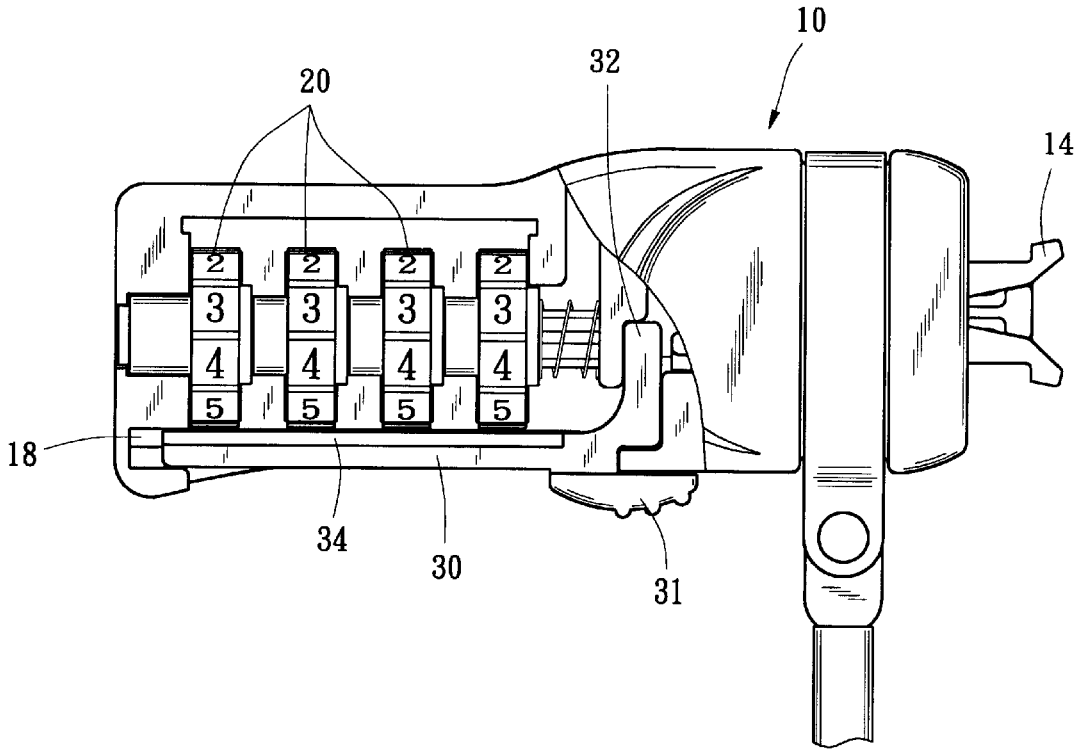
FIG. 5 is a front and partially section view showing the unlocking state of the embodiment of FIG. 1.
Figure 6:
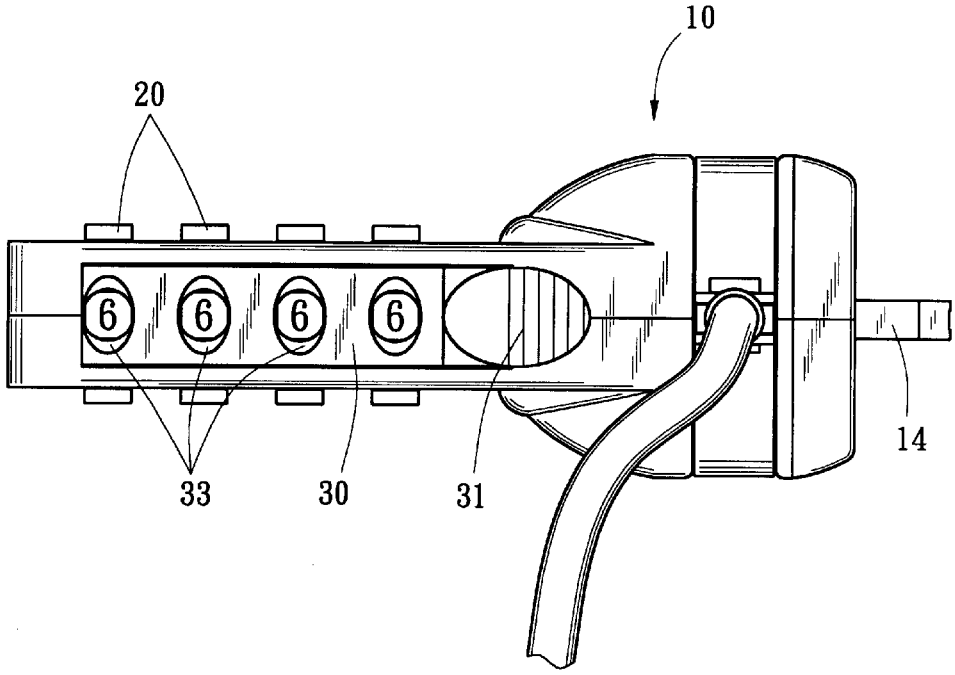
FIG. 6 is a side view according to FIG. 5.

Referring to FIGS. 5 and 6, when the numeral wheels 20 are turned to unlocking number, the press button 31 can be shifted in a direction of arrow of FIG. 5. At this time, the driving plate 32 drives the internal components of the lock to contract the hook members 14 into an unlocking state. At the same time, the window member 30 is transversely displaced to disalign the windows 33 from the numerals of the numeral wheels 20 (as shown in FIG. 6). Under such circumstance, the row of true unlocking numerals are shielded to prevent an unauthorized person from seeing the unlocking number.

Figure 7:
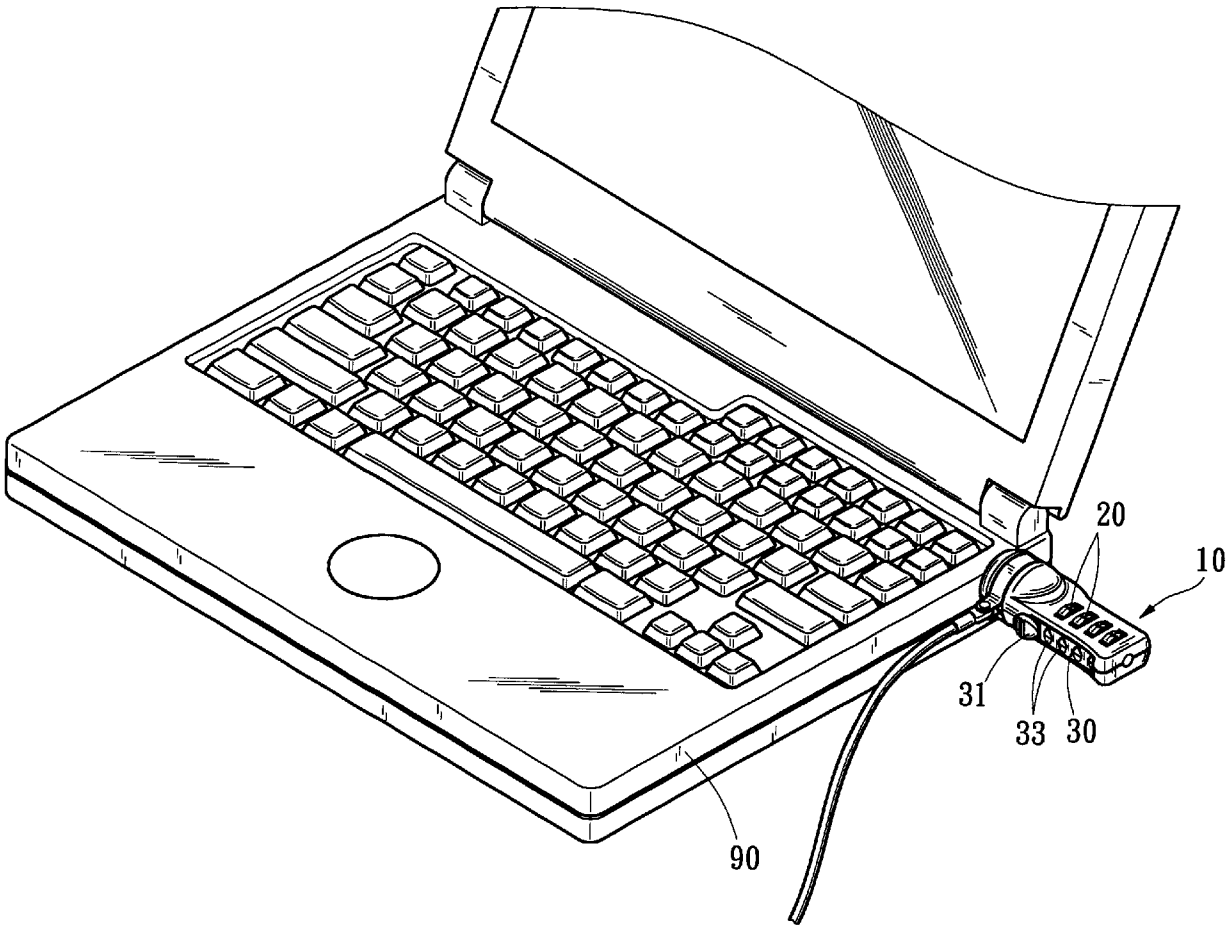
FIG. 7 shows that the present invention is mounted on a notebook-type computer.

Referring to FIG. 7, after mounted on a notebook-type computer 90, a user can with a finger turn the numeral wheels 20 one by one to show the unlocking number through the windows 33 of the window member 30. Then, the press button 31 is pressed to unlock the article and synchronously shield the unlocking number.

Figure 8:
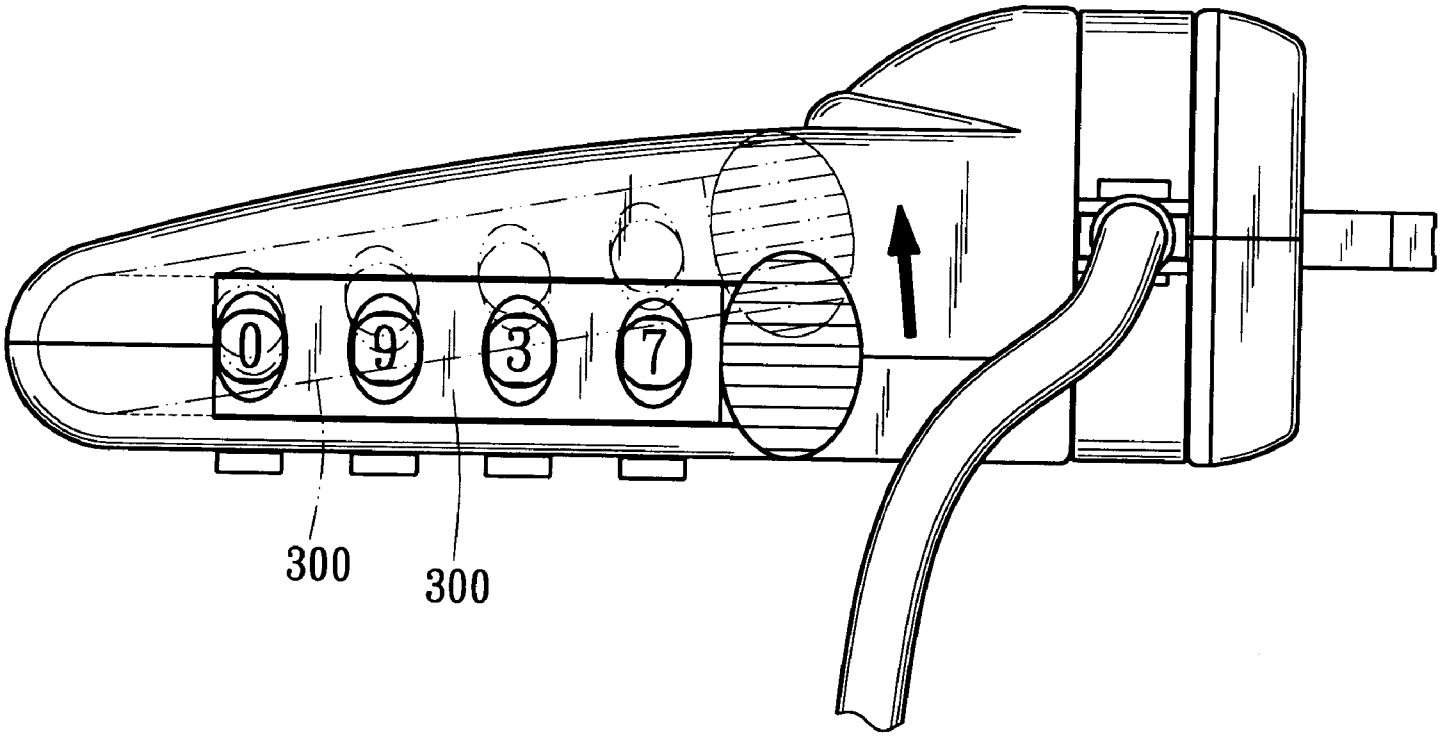
FIG. 8 is a side view of another embodiment of the present invention, showing the operation thereof.

FIG. 8 shows another embodiment of the present invention, in which the window member 300 is deflected to achieve a shielding effect. In FIG. 8, most part of the unlocking number "0937" shown through the window member 300 will be shielded when the window member 300 is deflected in a direction of the arrow.

Figure 9:
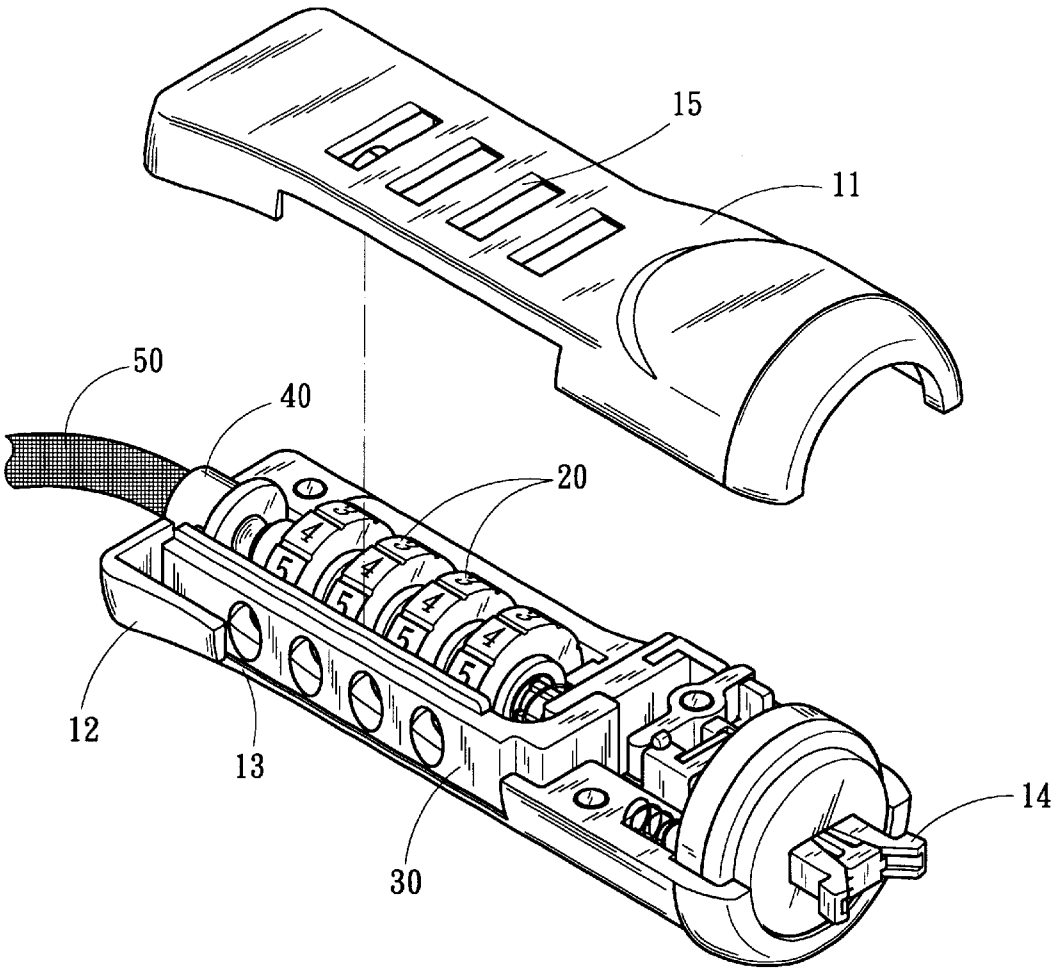
FIG. 9 is a perspective exploded view of still another embodiment of the present invention, in which the press button is replaced by a cable for unlocking the lock.
Figure 10A:
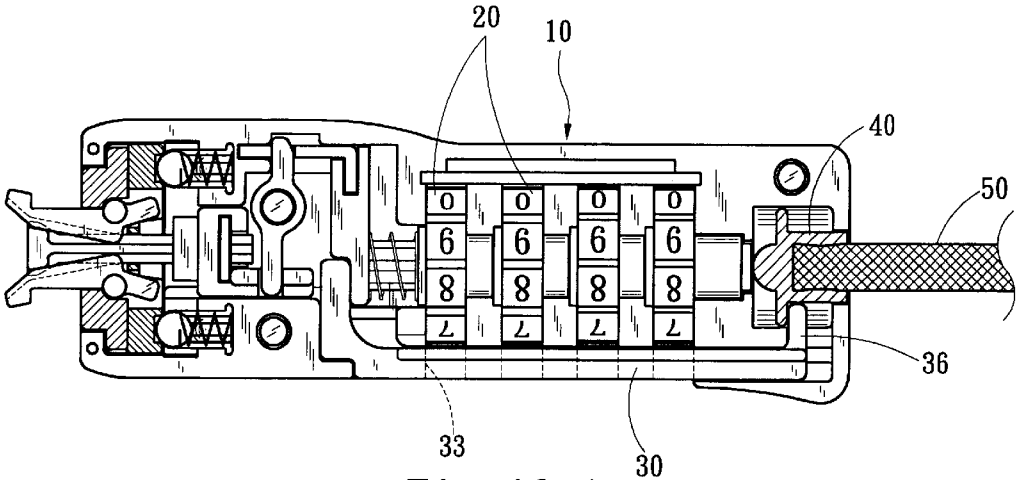
FIG. 10A shows the embodiment of FIG. 9 in a locking state.
Figure 10B:
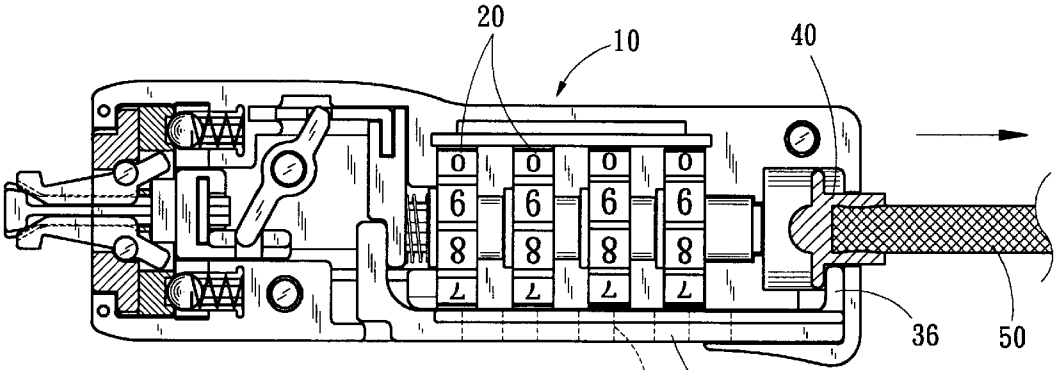
FIG. 10B shows the embodiment of FIG. 9 in an unlocking state.

FIGS. 9 and 10 show still another embodiment of the present invention, in which the window member 30 is driven by a cable. The window member 30 has an extension section 36 for connecting with an internal linking member 40. The linking member 40 is connected with an external cable 50. The press button 31 is replaced by the linking member 40 and the cable 50. When the cable 50 is pulled by an external force to drive the linking member 40 for unlocking, the window member 30 is driven and displaced to at the same time shield the unlocking number of the numeral wheels 20.

Figure 11:
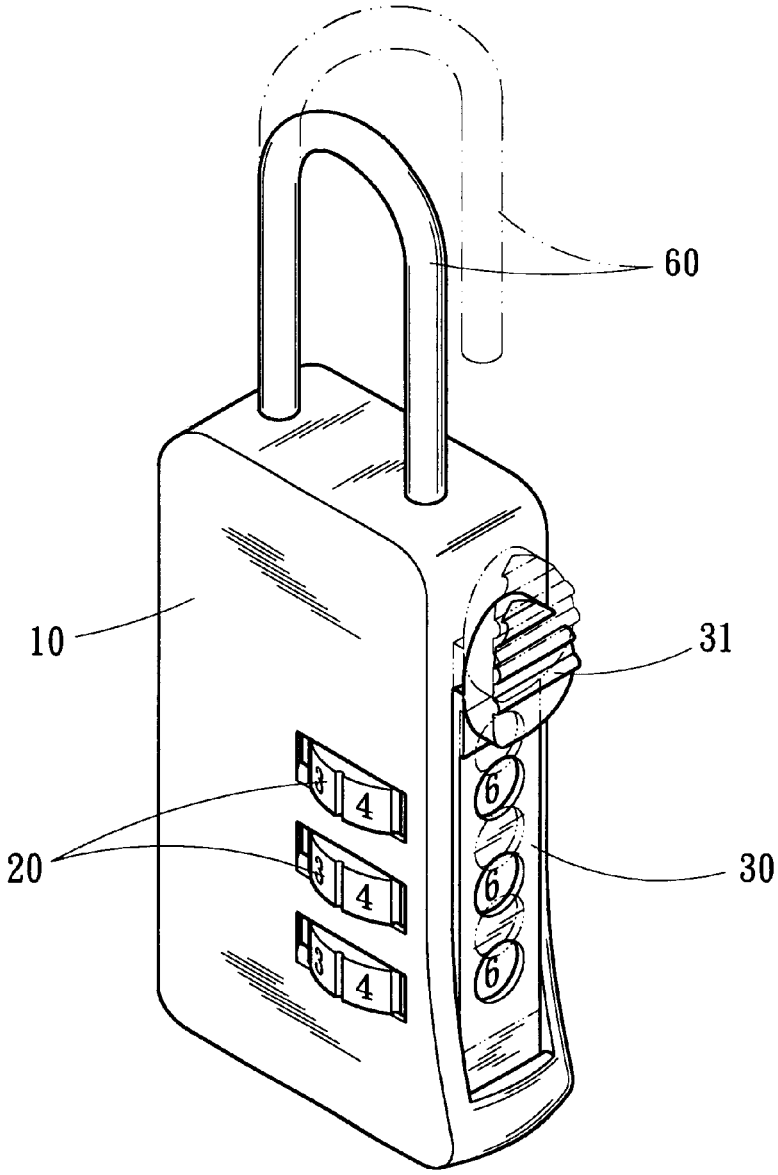
FIG. 11 is a perspective view showing that the present invention is applied to a hanging lock.
Figure 12:
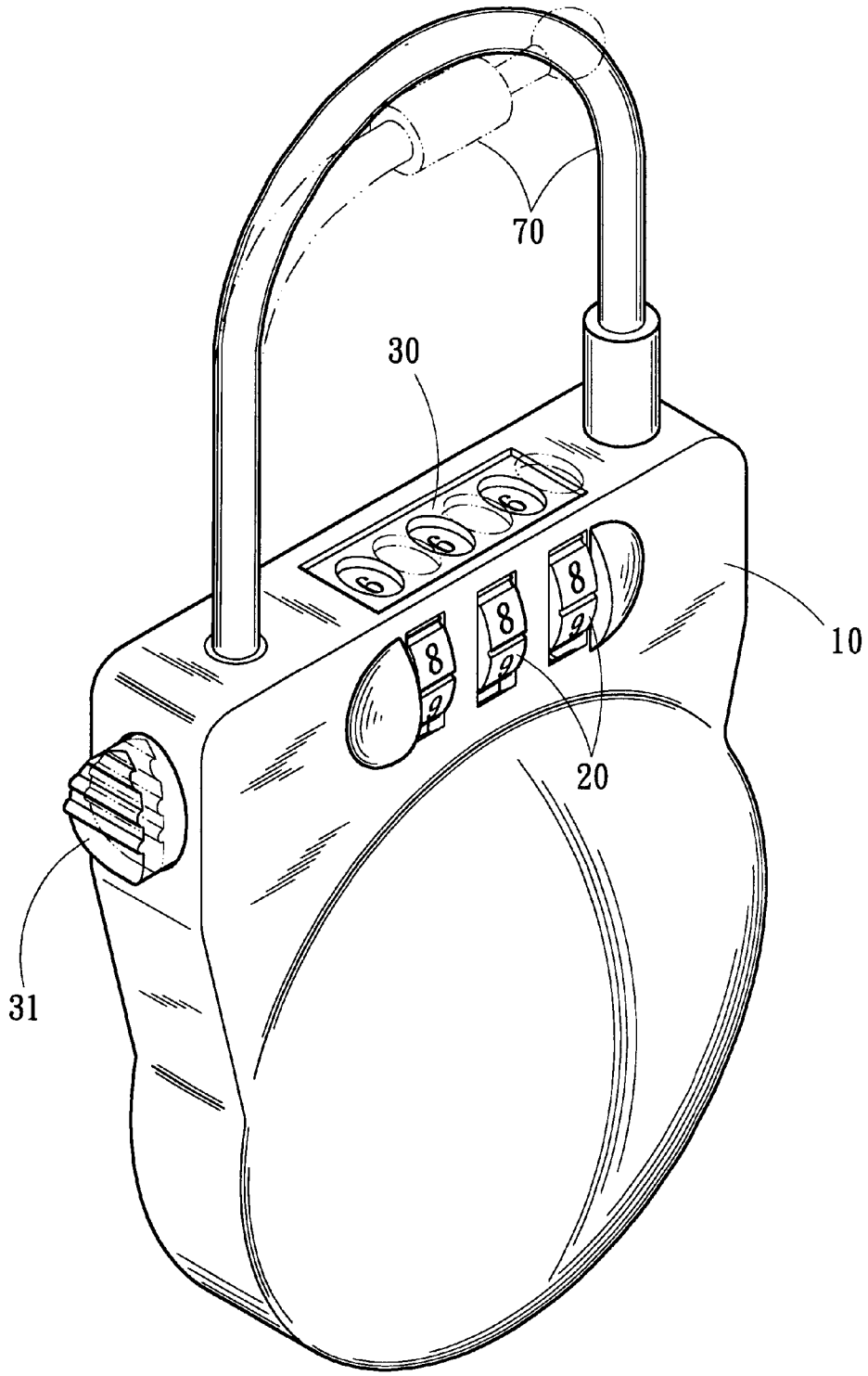
FIG. 12 is a perspective view showing that the present invention is applied to a cable hanging lock.
Figure 13:
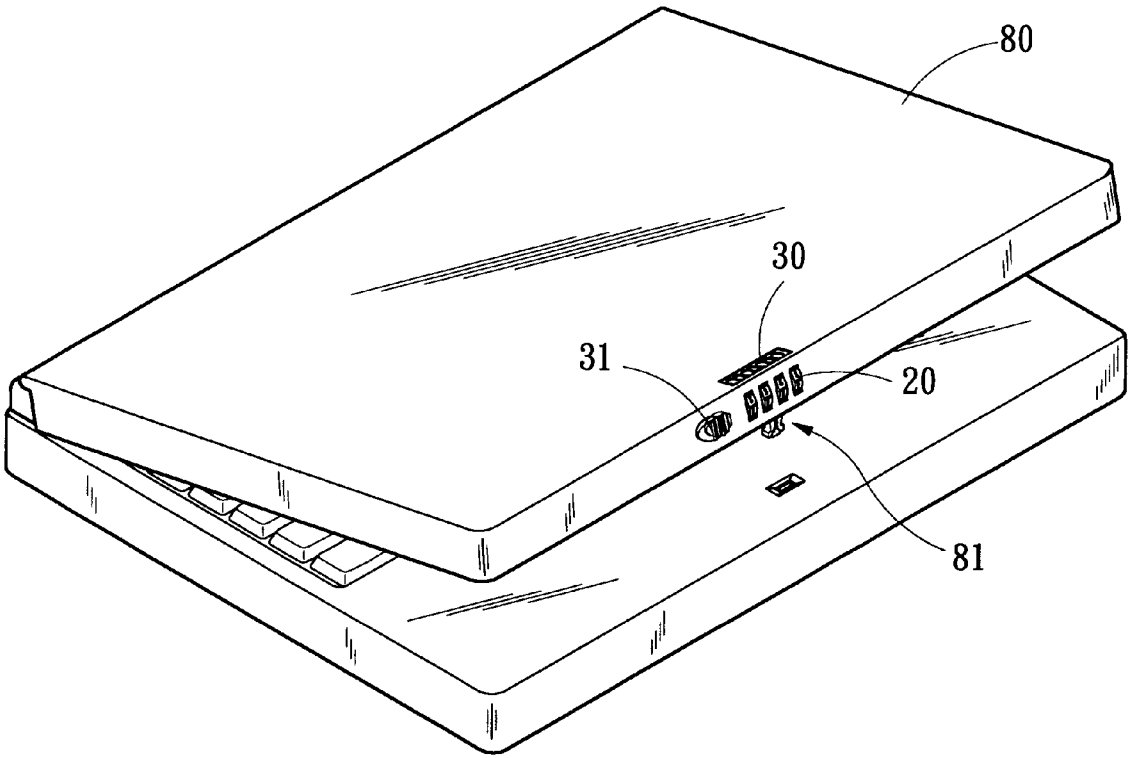
FIG. 13 is a perspective view showing that the present invention is directly made on a computer housing.

FIGS. 11 to 13 show the application of the shielded window structure of numeral lock of the present invention. In FIG. 11, the shielded window structure is applied to a hanging lock having a hanging hook 60. In FIG. 12, the shielded window structure is applied to a hanging lock having a hanging cable 70. In FIG. 13, the shielded window structure is applied to a numeral lock 81 directly made on a portable computer 80.

The above embodiments are only used to illustrate the present invention, not intended to limit the scope thereof. Many modifications of the above embodiments can be made without departing from the spirit of the present invention.

What is claimed is:

1. A shielded window structure of a numeral lock comprising a row of numeral wheels disposed in a housing of the lock, the circumference of the numeral wheels being partially exposed to an outer side through at least one face of the housing for easy turning, a linking member being drivingly connected with internal components to control locking/unlocking of a hook member at one end of the housing, a window member being disposed on one side of the housing corresponding to the numeral wheels, the window member being formed with a row of windows through which the numerals of the numeral wheels are exposed, said shielded window structure being characterized in that the linking member being drivingly connected with an internal driving plate for driving internal locking components, whereby the driving plate is integrally assembled with the window member and when unlocked, the window member is synchronously displaced to disalign the windows from the unlocking number shown through the windows so as to shield the unlocking member of the numeral wheels.

2. The shielded window structure of the numeral lock as claimed in claim 1, wherein the window member is synchronously horizontally displaceably connected with the linking member.

3. The shielded window structure of the numeral lock as claimed in claim 2, wherein one end section of the window member is integrally bent to form the internal driving place.

4. The shielded window structure of the numeral lock as claimed in claim 3, wherein the upper and lower sides of the window member are formed with slide ribs, the housing being composed of an upper and a lower casings, the upper and lower casings being formed with opposite elongated notches which together form an elongated slot in which the window member is disposed, inner side of the elongated slot being formed with channel rails in which the slide ribs of the window member are slidably inlaid.

5. The shielded window structure of the numeral lock as claimed in claim 1, wherein the window member is synchronously deflectably connected with the linking member.

6. The shielded window structure of the numeral lock as claimed in claim 1, wherein the linking member is a press button.

7. The shielded window structure of the numeral lock as claimed in claim 1, wherein the linking member is pulled and driven by a cable.

8. The shielded window structure of the numeral lock as claimed in claim 1, wherein the window structure is mounted on a hanging lock.

9. The shielded window structure of the numeral lock as claimed in claim 5, wherein the window structure is mounted on a hanging lock.

10. The shielded window structure of the numeral lock as claimed in claim 1, wherein the window structure is mounted on a cable hanging lock.

11. The shielded window structure of the numeral lock as claimed in claim 5, wherein the window structure is mounted on a cable hanging lock.

12. The shielded window structure of the numeral lock as claimed in claim 1, wherein the window structure is mounted on a lock of a computer housing.

13. The shielded window structure of the numeral lock as claimed in claim 5, wherein the window structure is mounted on a lock of a computer housing.

* * * * *